US007941882B1

(12) United States Patent
Strozer

(10) Patent No.: US 7,941,882 B1
(45) Date of Patent: May 17, 2011

(54) MAGNETIC CUSHIONING SYSTEM

(76) Inventor: Jeremy Robert Strozer, Falls Church, VA (US)

( * ) Notice: Subject to any disclaimer, the term of this patent is extended or adjusted under 35 U.S.C. 154(b) by 0 days.

(21) Appl. No.: 12/831,214

(22) Filed: Jul. 6, 2010

(51) Int. Cl.
*A47C 27/00* (2006.01)

(52) U.S. Cl. ..... 5/693; 5/697; 5/906; 5/935

(58) Field of Classification Search ..... 5/693, 906, 5/690, 694, 697, 727, 719, 935, 936
See application file for complete search history.

(56) References Cited

U.S. PATENT DOCUMENTS 3,467,973 A * 9/1969 Minnick ..... 5/719
3,604,027 A * 9/1971 Konno ..... 5/697
5,103,513 A * 4/1992 King ..... 5/118
5,625,914 A * 5/1997 Schwab ..... 5/690

* cited by examiner

*Primary Examiner* — Robert G Santos

(57) ABSTRACT

The magnetic cushioning system is for use in a cushion, mattress or other cushioned article, the cushioning system providing adjustable firmness for the user. The magnetic cushioning system includes a plurality of magnetic supports enclosed within a cover. Each of the magnetic supports has a flexible shell having opposed upper and lower ends. A permanent magnet is disposed within the flexible shell and is positioned adjacent the upper end thereof. An electromagnet is disposed within the flexible shell and is positioned adjacent the lower end thereof. The cover has opposed upper and lower surfaces, the magnetic supports having the upper ends thereof secured to a lower face of the upper surface, and the lower ends thereof secured to an upper face of the lower surface of the cover. A controller is provided for selectively and adjustably controlling electrical power transmitted to each electromagnet.

2 Claims, 2 Drawing Sheets

MAGNETIC CUSHIONING SYSTEM

BACKGROUND OF THE INVENTION

1. Field of the Invention

The present invention relates to cushioned supports, and particularly to a magnetic cushioning system formed for a cushioned article, the cushioning system providing adjustable firmness for the user.

2. Description of the Related Art

Common mattresses typically fall into one of three major categories: foam and batting, water bladder, or air bladder mattresses. A traditional mattress and foundation combination utilizes a box spring having a series of vertical springs arranged along the entire width and length of the box spring. These provide support for the mattress that is placed thereon. The mattress itself may include various internal components, such as vertical springs, wiring, cording, and soft batting materials, such as cotton and foam. The firmness of the mattress is a function of the combination of compressive properties of each material. A "firm" mattress may utilize stiff vertical springs and a relatively dense foam and cotton batting to form a "pillow-top". One limitation of these traditional mattress and box-spring combinations is that the firmness of the mattress system can only be adjusted by replacing the components. Further, the firmness of the mattress changes with age of the materials, along with wearing of particular areas. Further, depressions in the mattress may develop over time.

Water bladders, commonly known as waterbeds, utilize a bladder, which is filled with water. The firmness of the bed is controlled by the amount of water in the bladder and the resulting fluid pressure. Various bladder designs are available which provide wave support to prevent the water in the bladder from creating a wave. Further, multiple bladders may be used to provide various zones of firmness. Similar to the traditional mattress and box-spring design, adding or removing water is the only way to change the firmness of the water bladder bed. Water has a disadvantage over conventional mattress materials in that, when weight is applied to one location, the displaced water raises the bladder in another area. Another disadvantage of these mattresses is the susceptibility of the bladder being compromised, resulting in the water leading from the mattress.

The third common bed configuration is the air mattress. Like a waterbed, the air mattress utilizes a bladder or multiple bladders filled with air. One type of airbed configuration allows two users to adjust each side of the bed independently. The user may adjust the firmness of the bed by pumping air into, or removing air from, the bladder. The most common types of airbeds typically do not allow the user to adjust the firmness along the length of the bladder, such as for example, the area of the user's lower back being adjusted to be firmer than the area near the head of the bed. A multiple bladder system, using more than one bladder per sleeping area, could be used to provide adjustable comfort. However, bladder systems, both air and water, have a disadvantage over conventional mattresses in that when weight is applied to one location, the displaced air or water raises the bladder in another area. Thus, if the bladder system is set as soft, a heavy person's mass displaces more air or water at the heaviest areas, such as the hips, which raises the head or foot area.

Another alternative to conventional mattresses, along with air or water bladders, is the foam bed. These foam systems are typically composed of polyurethane or urethane foams. These mattresses may be used with a conventional box spring and the mattress itself may utilize foam of different densities along the length of the mattress, or even use an integral spring system. A disadvantage of the foam bed is that firmness of the mattress cannot be adjusted, and the foam is subject to fatigue and loss of its rigidity.

Hospital-style beds often use a viscoelastic foam to help prevent pressure sores (subcutaneous ulcers) forming on bed-confined patients. Most hospital beds have adjustable positions, however, they do not provide adjustable firmness along the length of the bed. Hospitals also utilize air mattress systems that may utilize an active air pump to maintain the pressure in the mattress. These air pumps are typically noisy and often disturbing to the patient.

Although the above bed systems provide various methods of support, they lack the ability to provide adjustability of firmness along the length of the bed (i.e., from foot to head) or across its width. Thus, it is desirable to provide a sleep system that provides for adjustable firmness at multiple locations along the mattress. Thus, a magnetic cushioning system solving the aforementioned problems is desired.

BRIEF SUMMARY OF THE INVENTION

The magnetic cushioning system is for use in a cushion, mattress or any other cushioned article, the system providing adjustable firmness for the user. The magnetic cushioning system includes a plurality of magnetic supports received within a cover. Each of the magnetic supports has a flexible shell formed from a fabric or the like, and having opposed upper and lower ends connected with an adjustable axis.

A permanent magnet is received within the flexible shell, and is positioned and secured within the flexible shell adjacent the upper end thereof. Additionally, an electromagnet is also received within the flexible shell and is positioned and secured within the flexible shell adjacent the lower end thereof. The permanent magnet and the electromagnet are connected by an adjustable axis, thus preventing the permanent magnet from achieving too great a distance from the electromagnet. It should be understood that the positioning of the permanent magnet and the electromagnet may be interchanged. The polarities of the permanent magnet and the electromagnet are arranged so that the permanent magnet and the electromagnet repel one another.

The cover has opposed upper and lower surfaces, with the plurality of the magnetic supports being received within the cover so that the upper ends thereof are secured to a lower face of the upper surface of the cover, and the lower ends of the plurality of the magnetic supports are secured to an upper face of the lower surface of the cover. The permanent magnet and the electromagnet are connected by an adjustable axis, thus preventing the permanent magnet from achieving too great a distance from the electromagnet. A controller is further provided for selectively and adjustably controlling electrical power transmitted to each electromagnet of each magnetic support, allowing the user to selectively and adjustably control the repulsive force between the permanent magnets and the respective electromagnets, thus controlling the firmness of the cushioned article.

These and other features of the present invention will become readily apparent upon further review of the following specifications and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
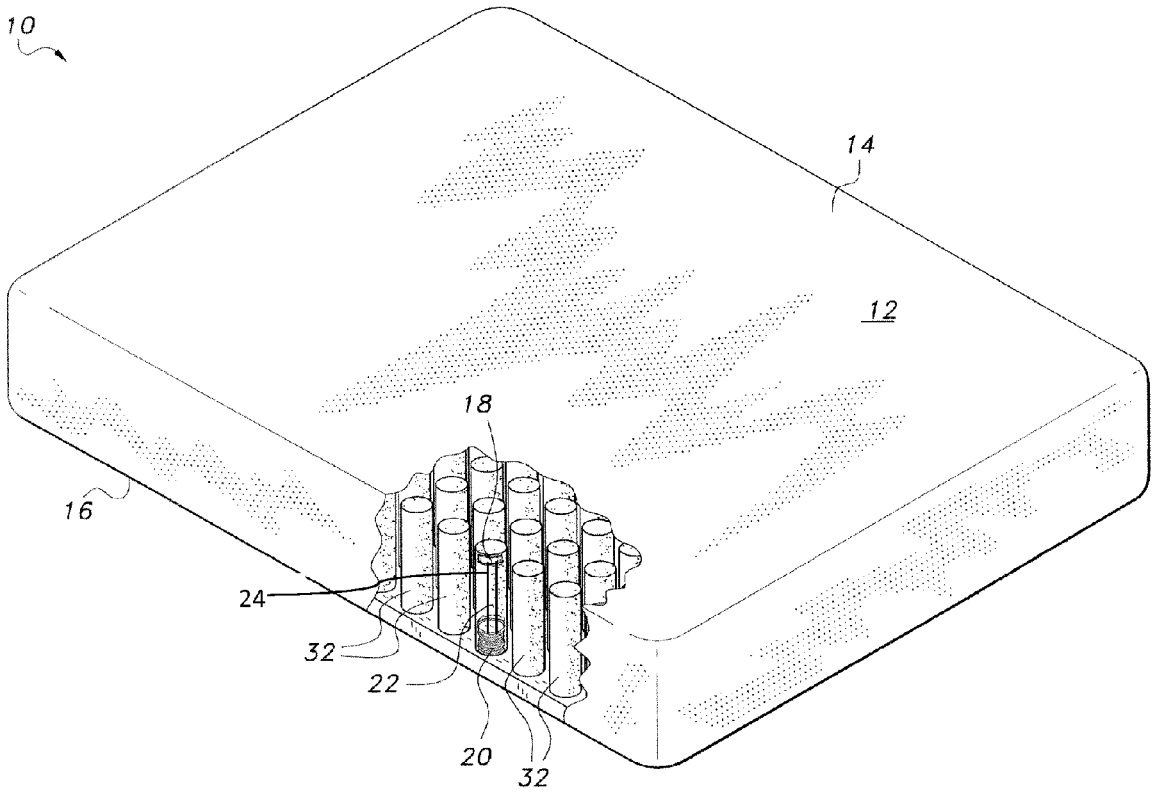
FIG. 1 is a perspective view of a mattress having a magnetic cushioning system according to the present invention, the mattress being broken away to show a portion of the system.

Referring to FIG. 1, the magnetic cushioning system 10 is a cushioning system for a seat cushion, mattress, or any other type of cushioned article, the cushioning system providing adjustable firmness for the user. It should be understood that the mattress shown in FIG. 1 is exemplary only, and that the magnetic cushioning system 10 may be incorporated into any suitable type of mattress, seat cushion, car seat, futon, or other cushioned article. Similarly, the overall shape and relative dimensions of the mattress of FIG. 1 are exemplary only, and may vary from that shown in the drawing.

The magnetic cushioning system 10 includes a plurality of magnetic supports 32 enclosed within a cover 12. Cover 12 may be formed from fabric or the like, as is conventionally known in the manufacture of mattresses, cushions and the like. Each of the magnetic supports 32 has a flexible shell 22 formed from fabric, vinyl, elastic or the like, and has opposed upper and lower ends 28, 30, respectively.

Figure 2:
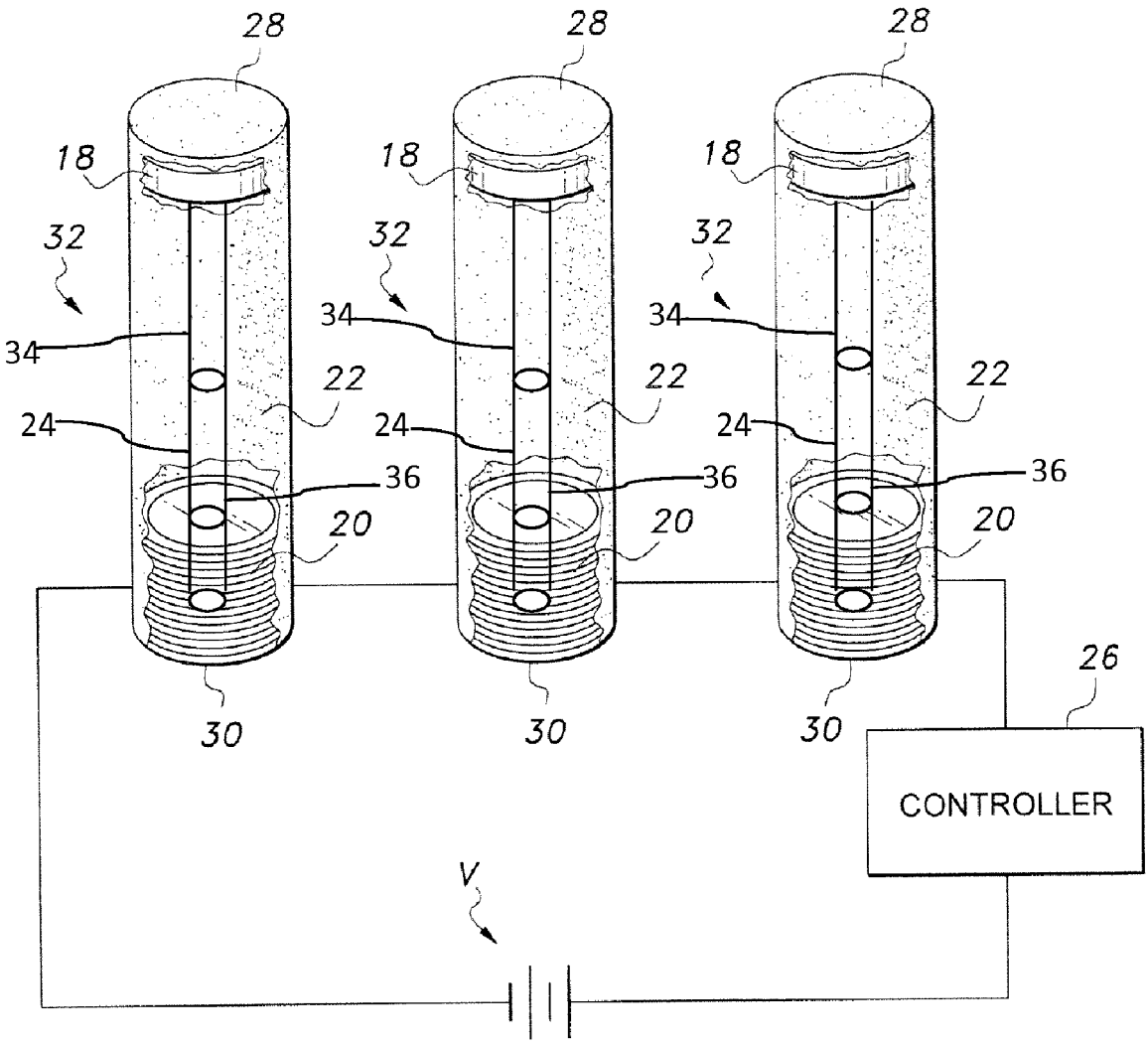
FIG. 2 is a diagrammatic view of a simple magnetic cushioning system according to the present invention.

As best shown in FIG. 2, a permanent magnet 18 is disposed within the flexible shell 22, and is positioned and secured within the flexible shell 22 adjacent the upper end 28 thereof. The permanent magnet 18 may be secured therein by any suitable type of permanent fastener, such as adhesives, stitching or the like.

It should be understood that the positioning of the permanent magnet 18 and the electromagnet 20 may be interchanged. The polarities of the permanent magnet 18 and the electromagnet 20 are arranged so that the permanent magnet 18 and the electromagnet 20 repel one another. Any suitable type of permanent magnet may be used, such as common ferromagnets, rare earth magnets, and the like. The size and shape of each magnet depends upon the particular application of system 10 (i.e., whether system 10 is a relatively large mattress, a small cushion, etc.). Similarly, the number of magnetic supports 32 also depends upon the particular application of system 10, and the shape and relative dimensions of the supports 32 also depend upon the particular application, size and configuration of the overall product. In the drawings, each shell 22 is shown as being substantially cylindrical, with a cylindrical magnet 18 and a cylindrical electromagnet 20 disposed therein. It should be understood that this configuration is shown for exemplary purposes only. As an example of an alternative configuration, shells 22 may be substantially rectangular or square structures. As a further alternative, the separate shells may be replaced by an internal rectangular or square grid of compartments formed by lateral and longitudinal partitions of the same flexible materials as shells 22.

Similarly, it should be understood that any suitable type of electromagnet may be used, such as the exemplary solenoid coil illustrated in FIG. 2. Additionally, it should be understood that permanent magnets 18 may be replaced by a second set of electromagnets. In FIG. 2, only three magnetic supports 22 are shown. It should be understood that this simple arrangement is shown for exemplary and illustrative purposes only.

The cover 12, as shown in FIG. 1, has opposed upper and lower surfaces 14, 16, respectively, with the plurality of magnetic supports 32 being disposed within the cover 12 so that the upper ends 28 thereof are secured to a lower face (or interior face) of the upper surface 14 of the cover 12, and the lower ends 30 of the plurality of magnetic supports 32 are secured to an upper face (or interior face) of the lower surface 16 of the cover 12. The magnetic supports 32 may be secured therein via any suitable type of permanent fastener, such as adhesives, stitching or the like.

The permanent magnets 18 are further secured to the electromagnets 20 with an adjustable axis or tether 24 that can compress or extend to the full length of the flexible chamber in which the magnetic structure is enclosed. The top of the axis or tether 24 is connected to the permanent magnet 18 (although this can be reversed) with the bottom of the axis or tether 24 resting within an empty core of the electromagnet structure 20. Thus, the axis or tether 24 can extend the full distance between the permanent magnet 18 and the electromagnet 20 and compress the minimum distance between the permanent magnet 18 and the electromagnet 20, allowing for structural integrity of the magnetic system throughout the system's extension range. The flexible axis or tether 24 can be made of any solid material that allows for a hollow cylindrical shaft 34 to travel the length of a second, wider, hollow cylindrical shaft 36.

A controller 26 is further provided for selectively and adjustably controlling electrical power V transmitted to each electromagnet 20 of each magnetic support 32, as shown in FIG. 2. Although shown in FIG. 2 as being arranged in series (i.e., the three illustrated electromagnets 20 are connected in series with power source V and controller 26), it should be understood that any desired arrangement may be used, depending upon the nature of controller 26.

Controller 26 may be any suitable type of programmable or user-actuable controller, such as a programmable logic controller, a personal computer or the like, allowing the user to selectively and adjustably control the repulsive force between the permanent magnets 18 and their respective electromagnets 20, thus controlling the firmness of the mattress 10. In use, the user may increase the electrical power flowing through electromagnets 20, thus increasing the repulsive force between electromagnets 20 and permanent magnets 18 (i.e., increasing the firmness of the mattress), or may selectively and adjustably decrease the electrical power flowing through electromagnets 20, thus decreasing the repulsive force between electromagnets 20 and permanent magnets 18 (i.e., decreasing the firmness of the mattress).

It is to be understood that the present invention is not limited to the embodiments described above, but encompasses any and all embodiments within the scope of the following claims. (Claims Submitted Separately)

I claim:

1. A magnetic cushioning system, comprising:

a plurality of magnetic supports, each of the supports having a flexible shell, the flexible shell having opposed upper and lower ends, each of the supports further including a permanent magnet disposed within the flexible shell and positioned adjacent the upper end thereof, and an electromagnet disposed within the flexible shell and positioned adjacent the lower end thereof, and a flexible mechanism that can extend or contract between the permanent magnet and the electromagnet that provides structure between the two;

a cover having opposed upper and lower surfaces, the plurality of magnet supports being enclosed within the cover, the upper ends of the shells being secured to a lower face of the upper surface of the cover, the lower ends of the shells being secured to an upper face of the lower surface of the cover; and means for selectively and adjustably controlling electrical power transmitted to each electromagnet of each of the magnetic supports.

2. The magnetic cushioning system as recited in claim 1, wherein said cover is formed from fabric.

* * * * *